United States Patent [19]

Bono

[11] Patent Number: 4,873,728

[45] **Date of Patent: * Oct. 17, 1989**

[54] PORTABLE DISINFECTING DEVICE FOR A TOILET SEAT AND OTHER SURFACES

[76] Inventor: Salvatore Bono, 885 Manor La., Bay Shore, N.Y. 11706

[ * ] Notice: The portion of the term of this patent subsequent to Dec. 22, 2004 has been disclaimed.

[21] Appl. No.: 244,019

[22] Filed: Sep. 14, 1988

[51] Int. Cl.[4] ..... A47K 17/00

[52] U.S. Cl. ..... 4/233; 15/210 R

[58] Field of Search ..... 4/229, 230, 231, 232, 4/233, 222, 237, 243; 15/210 R, 246; 206/205; 400/636

[56] References Cited

U.S. PATENT DOCUMENTS

| | | | |
|---|---|---|---|
| 1,512,174 | 10/1924 | Isaac | 15/210 R |
| 2,495,498 | 1/1950 | Allard | 4/232 |
| 4,433,925 | 2/1984 | Fujiwara et al. | 400/636 |
| 4,575,891 | 3/1986 | Valente | 4/233 |
| 4,601,081 | 7/1986 | Sutton et al. | 15/210 R |
| 4,713,845 | 12/1987 | Bono | 4/233 |

FOREIGN PATENT DOCUMENTS

| | | | |
|---|---|---|---|
| 52034 | 10/1911 | Austria | 4/233 |
| 0221017 | 5/1987 | European Pat. Off. | 4/233 |
| 510241 | 10/1930 | Fed. Rep. of Germany | 4/233 |
| 12200 | 5/1907 | United Kingdom | 4/233 |

*Primary Examiner*—Henry J. Recla
*Assistant Examiner*—Glenn T. Barrett
*Attorney, Agent, or Firm*—Michael I. Kroll

[57] ABSTRACT

A portable disinfecting device for a toilet seat and other surfaces is provided that is manually slideable upon the toilet seat and the other surfaces to disinfect them from a roll of disinfectant tissue. The device has a replaceable refill cartridge which holds both a liquid disinfectant dispenser and a new roll of disinfectant tissue therein.

5 Claims, 1 Drawing Sheet

PORTABLE DISINFECTING DEVICE FOR A TOILET SEAT AND OTHER SURFACES

BACKGROUND OF THE INVENTION

1. Field of the Invention

The instant invention relates generally to cleansing apparatuses and more specifically it relates to a portable disinfecting device for a toilet seat and other surfaces.

2. Description of the Prior Art

Numerous cleansing apparatuses have been provided in prior art that are adapted to destroy, neutralize and inhibit the growth of harmful microorganisms on toilet seats and the like. While these units may be suitable for the particular purpose to which they address, they would not be as suitable for the purposes of the present invention as heretofore described.

SUMMARY OF THE INVENTION

A primary object of the present invention is to provide a portable disinfecting device for a toilet seat and other surfaces that will overcome the shortcomings of the prior art devices.

Another object is to provide a portable disinfecting device for a toilet seat and other surfaces that is manually slideable upon the toilet seat and other surfaces to disinfect them from a roll of disinfectant tissue.

An additional object is to provide a portable disinfecting device for a toilet seat and other surfaces that has a replaceable refill cartridge which holds both a liquid disinfectant dispenser and a new roll of disinfectant tissue therein.

A further object is to provide a portable disinfecting device for a toilet seat and other surfaces that is simple and easy to use.

A still further object is to provide a portable disinfecting device for a toilet seat and other surfaces that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
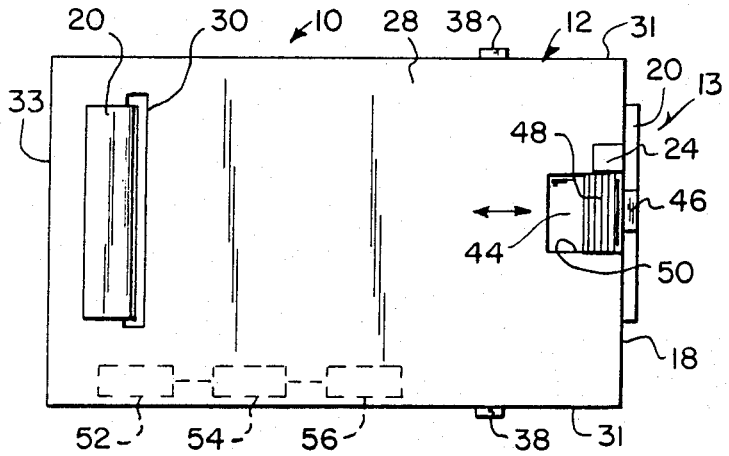
FIG. 1 is a top view of the invention.
Figure 3:
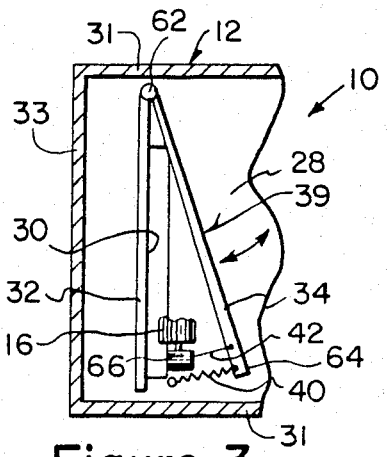
FIG. 3 is a cross sectional view taken along line 3—3 in FIG. 2, showing the tissue cutting mechanism.
Figure 2:
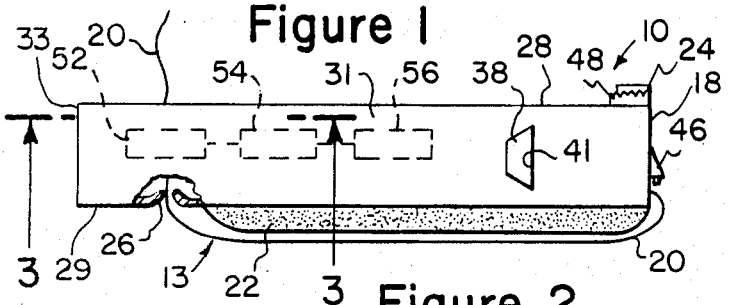
FIG. 2 is a side view with parts broken away.
Figure 4:
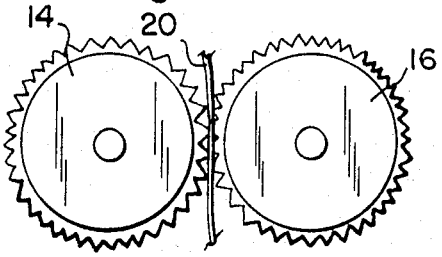
FIG. 4 is an end view of the first and second take up rollers with the disinfecting tissue therebetween.
Figure 5:
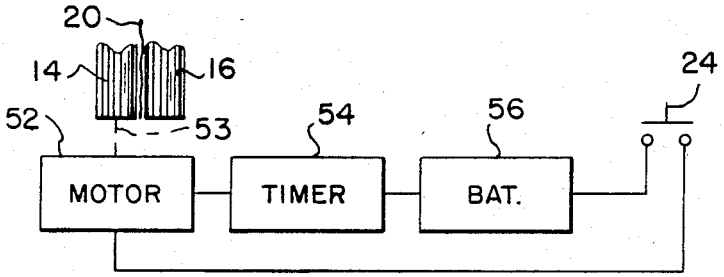
FIG. 5 is a block diagram of the electrical circuit therein.
Figure 7:
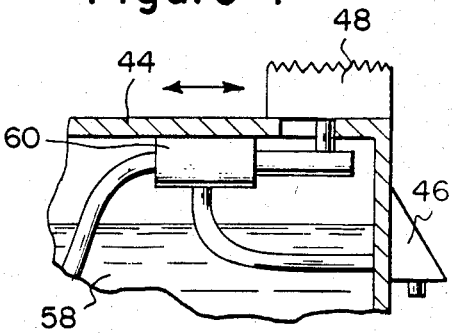
FIG. 7 is a partial cross sectional view through the refill cartridge to show the spray mechanism in greater detail.
Figure 6:
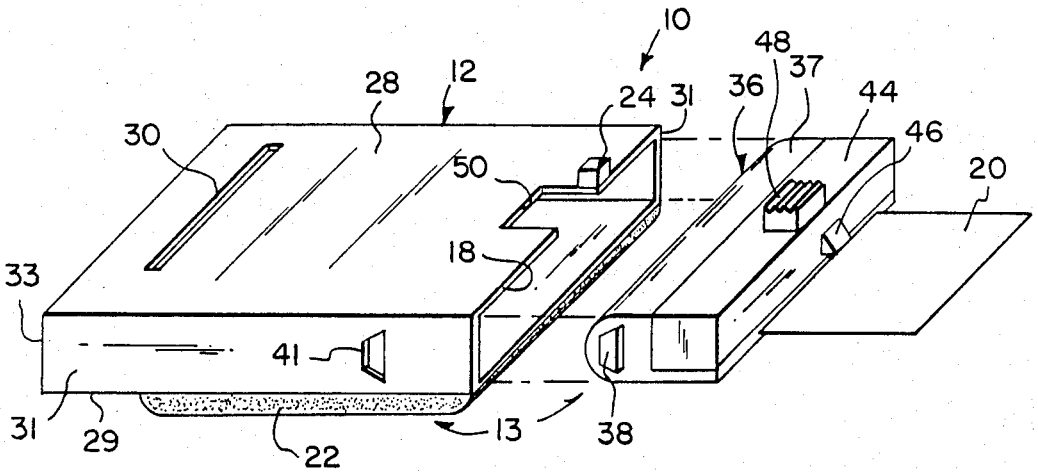
FIG. 6 is an exploded perspective view showing the replaceable refill cartridge separated therefrom.

Turning now descriptively to the drawings, in which similar reference characters denote similar elements throughout the several views the figures illustrate a portable disinfecting device 10 for a toilet seat and other surfaces (not shown) which consists of a housing 12 that will slide on the rim width of a toilet seat and against other surfaces when the housing 12 is manually manipulated. A mechanism 13 is provided for disinfecting the toilet seat and the other surfaces. The mechanism 13 is disposed in the housing 12 and extends therefrom so as to make contact with the toilet seat and the other surfaces.

The housing 12 includes a top wall 28, a bottom wall 29, a pair of side walls 31 and one end wall 33. The top wall 28 has a top slot 30 thereacross near one end and a cutout area 50 at other end. The bottom wall 29 has a bottom slot 26 thereacross directly below the top slot 30. Each of the side walls 31 has an aperture 41 therethrough while the housing 12 thereby has an open end 18 opposite the end wall 33.

The mechanism 13 includes a pair of take-up rollers 14 and 16, a sponge member 22, a replaceable refill cartridge 36 and a dispenser 44. The pair of take-up rollers 14 and 16 are rotatably mounted within the housing 12 in alignment with the top slot 30 in the top wall 28 and the bottom slot 26 in the bottom wall 29. The sponge member 22 is affixed to underside of the bottom wall 29 of the housing 12 between the bottom slot 26 and the open end 18 while the replaceable refill cartridge 36 is received within the open end 18 of the housing. The refill cartridge 36 is a casing 37 with a roll of disinfectant tissue 20 therein that extends outwardly from one side. The casing 37 has a pair of spring biased latch members 38 which mate with the apertures 41 in the side walls 31 of the housing 12. The dispenser 44 is mounted onto the refill cartridge 36 for spraying disinfectant liquid 58 therefrom onto the disinfectant tissue 20 that extends outwardly from the casing 37. The disinfectant tissue 20 goes around the sponge member 22 for making contact with the toilet seat and the other surfaces, then goes into the bottom slot 26 in the bottom wall 29 of the housing 12, between the take-up rollers 14 and 16 and upwardly through the top slot 30 in the top wall 28.

The dispenser 44 includes a pump 60 mounted therein while a spray head 46 is disposed into side of the dispenser 44 above the disinfectant tissue 20 and is connected to a pump 60. An actuator button 48 is slideably mounted to top of the dispenser 44 and extends through the cutout area 50 on the top wall 28 of the housing 12 to slide back and forth to operate the pump 60 so that the disinfectant liquid 58 can come out of the spray head 46 to impregnate the disinfectant tissue 20.

The device 10 further contains a motor 52, a timer 54, a battery 56 and a switch 24. The motor 52 is mounted within the housing 12 and has a shaft 53 connected to take-up roller 14. The timer 54 is mounted within the housing 12 and is electrically connected to the motor 52. The battery 56 is also mounted within the housing 12 and is electrically connected to the timer 54 to supply power thereto. The switch 24 is mounted to the top wall 28 of the housing 12 and is electrically connected between the battery 56 and the motor 52 so that when the switch 24 is depressed the timer will control operation of the motor 52 to rotate the first take-up roller 14, in which a right amount of the disinfectant tissue 20 will extend under the sponge member 22.

The device 10 further contains a mechanism 39 for automatically cutting off a used portion of the disinfectant tissue 20 when the switch 24 is depressed. The mechanism 39 includes a stationary blade 32, a moveable blade 34, a spool 66, a wire 42 and a spring 40. The stationary blade 32 is mounted to underside of the top wall 28 on one side of the top slot 30 while the moveable blade 34 is pivotly affixed at one end 62 to the stationary blade 32 at underside of the top wall 28 on other side of the top slot 30. The spool 66 is attached to one end of the second take-up roller 16. The wire 42 is affixed between free end 64 of the moveable blade 34 and the spool 66 while the spring 40 is attached between the free end 64 of the moveable blade 34 and underside of the top wall 28 of the housing 12.

When the motor 52 rotates the first take-up roller 14, the spool 66 will rotate with the second take-up roller 16 and wind up the wire 42 thereon allowing the moveable blade 34 to cut off the used portion of the disinfectant tissue 20. When the timer 54 stops the motor 52, the spring 40 will return the moveable blade 34 back to its original position allowing the wire 42 to unroll from the spool 66.

LIST OF REFERENCE NUMBERS

10 portable disinfecting device
12 housing
13 disinfecting mechanism
14 first take-up roller
16 second take-up roller
18 open end
20 disinfectant tissue
22 sponge member
24 switch
26 bottom slot
28 top wall
29 bottom wall
31 top slot
32 side wall
33 stationary blade
34 end wall
35 moveable blade
36 refill cartridge
37 casing for roll of disinfectant tissue
38 spring biased latch member
29 cutting mechanism
40 spring
41 aperture
42 wire
44 dispenser
46 spray head
48 actuator button
50 cutout area
52 motor
53 shaft
54 timer
56 battery
58 disinfectant liquid
60 pump
62 pivot end of moveable blade
64 free end of moveable blade
66 spool It will be understood that each of the elements described above, or two or more together, may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A portable disinfecting device for a toilet seat and other surfaces which comprises:

(a) a housing that will slide on rim width of the toilet seat and against the other surfaces when said housing is manually manipulated said housing including a top wall having a top slot thereacross near one end and a cutout area at other end for mounting an activate button, a bottom wall having a bottom slot thereacross directly below said top slot for receiving a disinfectant tissue and forwarding it through said top slot, a pair of side walls, each having an aperture for receiving a pair of spring biased members, one end wall having an open end opposite said end wall; and (b) means for disinfecting the toilet seat and the other surfaces, said means disposed in said housing and extends therefrom so as to make contact with the toilet eat and the other surface said disinfecting means including a pair of take-up rollers rotatably mounted within said housing in alignment with said top slot in said top wall and said bottom slot in said bottom wall, a sponge member affixed to underside of said bottom wall of said housing between said bottom slot and said open end, a replaceable refill cartridge which is received within said open end of said housing, said refill cartridge being a casing with a roll of disinfectant tissue therein that extends outwardly from one side, said casing having a pair of spring biased latch members which mate with said apertures in said side wall of said housing, and a dispenser mounted into said refill cartridge for spraying disinfectant liquid therefrom onto said disinfectant tissue that extends outwardly from said casing whereby said disinfectant tissue goes around said sponge member for making contact with the toilet seat and other surfaces, then goes into said bottom slot in said bottom wall of said housing, between said take-up rollers and upwardly through said top slot in said top wall.

2. A portable disinfecting device as recited in claim 1, wherein said dispenser includes:

(a) a pump mounted therein;

(b) a spray head disposed into side of said dispenser above said disinfectant tissue and connected to said pump;

(c) an actuator buttom slideably mounted to top of said dispenser, said actuator buttom extends through said cutout area on said top wall at said housing to slide back and forth to operate said pump so that said disinfectant liquid can come out of said spray head to impregnate said disinfectant tissue.

3. A portable disinfecting device as recited in claim 2, further comprising:

(a) a motor mounted within said housing, said motor having a shaft connected to one of said take-up rollers;

(b) a timer mounted within said housing and electrically connected to said motor;

(c) a battery mounted within said housing and electrically connected to said timer to supply power thereto; and (d) a switch mounted to said top wall of said housing and electrically connected between said battery and said motor so that when said switch is depressed said timer will control operation of said motor to rotate said first take-up roller in which a right amount of said disinfectant tissue will extend under said sponge member.

4. A portable disinfecting device as recited in claim 3, further comprising means for automatically cutting off a used portion of said disinfectant tissue when said switch is depressed.

5. A portable disinfecting device as recited in claim 4, wherein said cutting off means includes:

(a) a stationary blade mounted to underside of said top wall on one side of said top slot;

(b) a moveable blade pivotly affixed at one end to said stationary blade at underside of said top wall on other side of said top slot;

(c) a spool attached to end of said second take-up rollers;

(d) a wire affixed between free end of said moveable blade and said spool; and (e) a spring attached between said free end of said moveable blade and underside of said top wall of said housing so that when said motor rotates said first take-up roller said spool will rotate with said second take-up roller and wind up said wire thereon allowing said moveable blade to cut off said used portion of said disinfectant tissue whereby when said timer stops said motor said spring will return said moveable blade back to its original position allowing said wire to unroll from said spool.

* * * * *